US005102026A

United States Patent [19]

Messner

[11] Patent Number: 5,102,026

[45] Date of Patent: Apr. 7, 1992

[54] APPARATUS FOR AN INTERMITTENT FEEDING OF A WEBSHAPED WORKPIECE

[75] Inventor: Helmut Messner, Arbon, Switzerland

[73] Assignee: Bruderer AG, Frasnacht, Switzerland

[21] Appl. No.: 751,564

[22] Filed: Aug. 22, 1991

Related U.S. Application Data

[63] Continuation of Ser. No. 426,808, Oct. 24, 1989, abandoned.

[30] Foreign Application Priority Data

Oct. 26, 1988 [CH] Switzerland ..... 3984/881

[51] Int. Cl.[5] ..... B65H 20/04; F16H 29/00

[52] U.S. Cl. ..... 226/156; 226/147; 226/154; 226/158; 226/162; 74/130; 74/155

[58] Field of Search ..... 226/147, 152, 154, 156, 226/157, 158, 162, 165, 139; 74/130, 155

[56] References Cited

U.S. PATENT DOCUMENTS

| | | | |
|---|---|---|---|
| 2,946,586 | 7/1960 | Pityo | 271/2.4 |
| 3,022,680 | 2/1962 | Roojen | 74/230 X |
| 3,493,159 | 2/1970 | Balunas, Jr. et al. | 226/154 X |
| 3,638,846 | 2/1972 | Wiig | 226/142 |
| 3,758,011 | 9/1973 | Portmann | 226/142 |
| 3,784,075 | 1/1974 | Portmann | 226/143 |
| 4,792,074 | 12/1988 | Bareis et al. | 226/154 X |

FOREIGN PATENT DOCUMENTS

| | | | |
|---|---|---|---|
| 3330001 | 8/1984 | Fed. Rep. of Germany . | |
| 3347786 | 5/1985 | Fed. Rep. of Germany . | |
| 3526846 | 2/1986 | Fed. Rep. of Germany . | |
| 0917975 | 1/1947 | France . | |
| 2290972 | 6/1976 | France . | |
| 0228770 | 2/1925 | United Kingdom | 74/130 |

*Primary Examiner*—Daniel P. Stodola
*Assistant Examiner*—P. Bowen
*Attorney, Agent, or Firm*—Ladas & Parry

[57] ABSTRACT

A pair of arms is hingedly connected to a rocker. These arms support the pressing bar. At their opposite ends the arms are pivotably mounted such to the casing of the appratus that in one position thereof the axis of rotation of the lower feeding roller coincides with the pivot axis of the pivotal point of the arms at the casing. By this design it is no longer necessary to adjust the apparatus for the intermittent feeding of a web-shaped workpiece by utilizing auxiliary structures to various respective thicknesses of the web being fed.

14 Claims, 7 Drawing Sheets

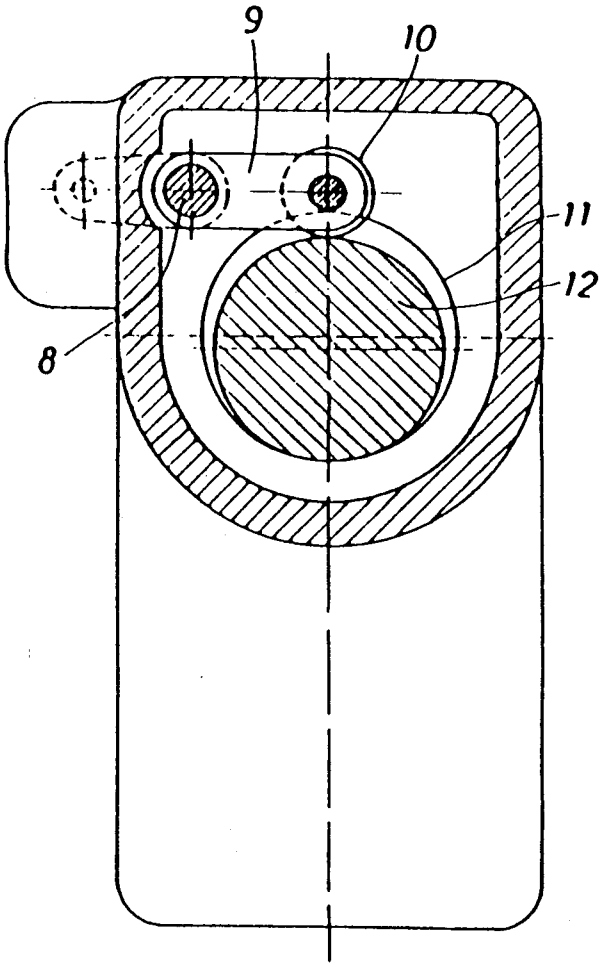
II-II Fig. 3
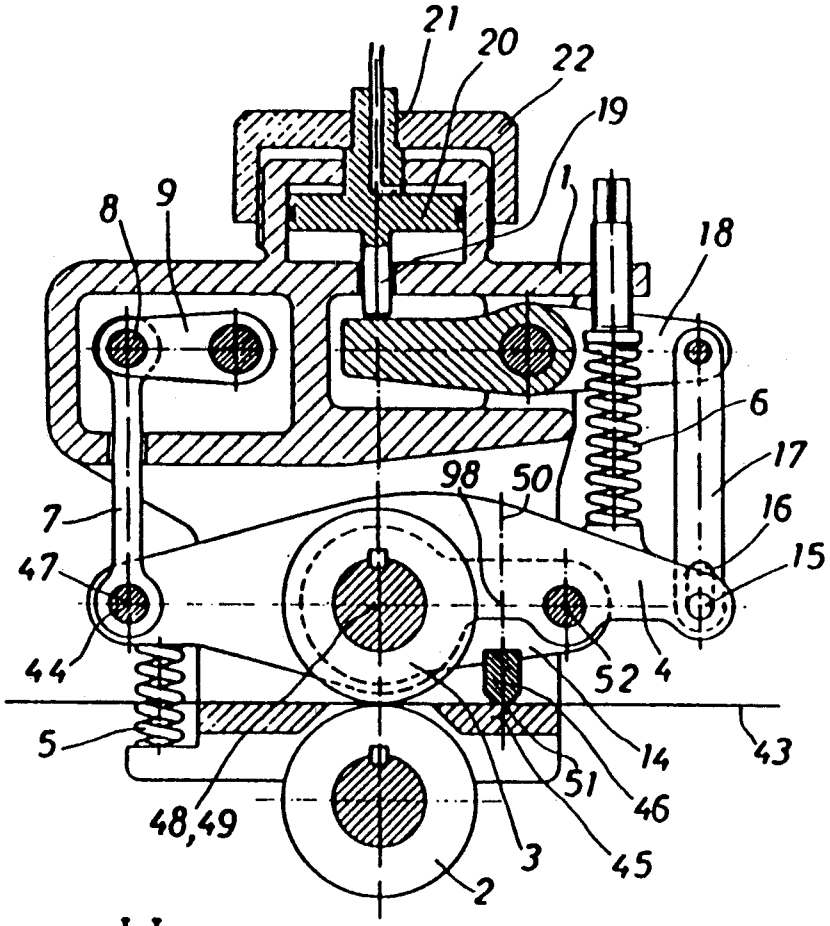
I-I Fig. 2

APPARATUS FOR AN INTERMITTENT FEEDING OF A WEBSHAPED WORKPIECE

This is a continuation of copending application Ser. No. 426,808, filed on Oct. 24, 1989, now abandoned.

BACKGROUND OF THE INVENTION

1. Field of the Invention

The present invention relates to an apparatus for intermittently feeding a web-shaped workpiece.

2. Description of the Prior Art

An apparatus of the kind mentioned above is disclosed in the U.S. Pat. Nos. 3,758,011 and 3,784,075. This apparatus includes two feeding rollers oscillatingly rotated rotating in opposite senses relative to each other. The feeding rollers receive a workpiece between them and in synchronism with the times they reverse their respective senses of rotation, move towards each other into a feeding position and away from each other into an idling position. An arresting mechanism for the workpiece is rendered operative in synchronism with the movement of the feeding rollers from their feeding position into their idling position and inoperative when the rollers move from the idling position into the feeding position. This known apparatus needs, therefore, a special mechanism for adjusting the individual operating members in dependence upon the thickness of a prevailing web, which adjusting causes obviously a stopping of the apparatus during a certain time span and which includes additional operating members, which are subject to wear during the normal operation.

SUMMARY OF THE INVENTION

It is, therefore, a general object of the present invention to provide an apparatus for an intermittent feeding of a web-shaped workpiece, which does not necessitate an additional mechanism unit for an adjusting the apparatus to various thicknesses of the web and accordingly allows the apparatus to be more compact and easier to maintain.

A further object is to provide an apparatus which comprises an oscillatingly movable link member and a first spring, which link member is pivotably mounted to one end of the rocker for driving same, at which end the rocker is supported further on the first spring; comprising further a supporting member and a further spring, on which supporting member the rocker is supportable at its other end, which end is further supported on the further spring; and which arresting means comprises a pressing bar located between two pivot arms pivotably mounted at one of their ends to the rocker and at their opposite ends to a frame part of the apparatus at a location, at which in one rocking position of the rocker their pivot axis coincides at least approximately with the axis of rotation of the pressing roller supported in the rocker.

BRIEF DESCRIPTION OF THE DRAWINGS

The present invention will be better understood and objects other than those set forth above will become apparent when consideration is given to the following detailed description thereof in conjunction with the appended drawings, wherein:

FIG. 2 is a section along line I—I of FIG. 1;

FIG. 3 is a section along line II—II of FIG. 1;

DESCRIPTION OF THE PREFERRED EMBODIMENTS

The preferred embodiment for intermittently feeding a web-shaped workpiece, for instance, sheet metal, includes a casing 1. An oscillating feeding unit is supported in this casing 1.

Figure 1:
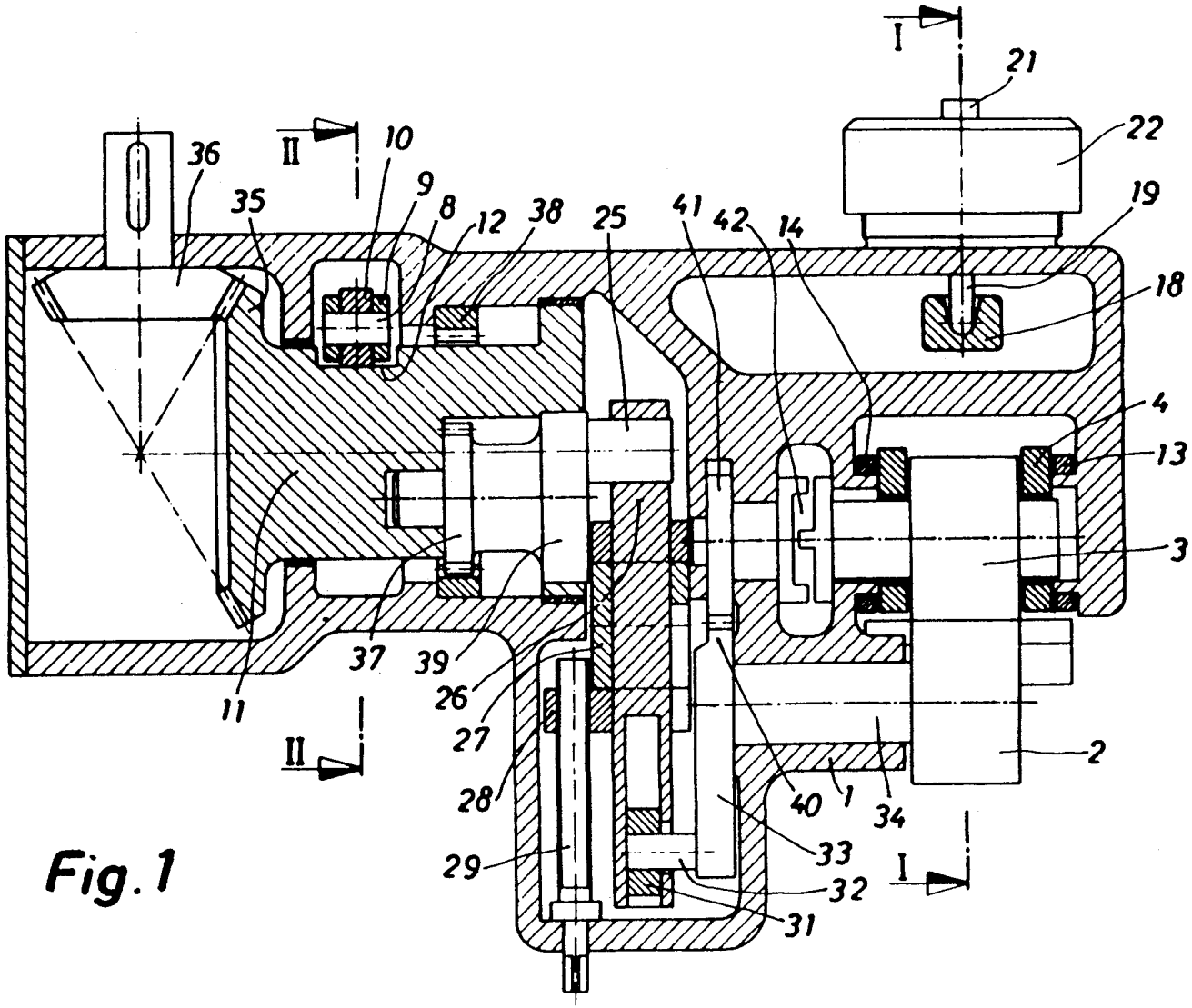
FIG. 1 is a sectional view of a first embodiment of a feeding apparatus.

In the embodiment illustrated in FIGS. 1 to 3, the feeding unit is a lower feeding roller 2 and an adjustably pressing, driven feeding roller 3 located adjacent the lower feeding roller. The two feeding rollers 2 and 3 of this embodiment are driven to rotate in opposite senses relative to each other by structures explained in detail further below. The upper feeding roller 3 is supported rotatably about axis 48 at both its ends in a rocker 4, which rocker 4 is supported at both sides of the upper feeding roller 3 via springs 5 and 6, respectively, on the casing 1. At the end of the rocker 4 which is supported on the spring 5, the rocker 4 is hingedly mounted via a link member (a rod) 7 and a shaft 8 to one end of a lever 9, which lever carries at its opposite free end a rotatably supported roller 10. This roller 10 cooperates with a cam member 12 located on a drive shaft 11. The drive of this drive shaft 11 is coupled to the drive of the two feeding rollers 2 and 3 and will be explained in detail further below. A pair of arms 13, 14 are hingedly mounted to the rocker 4, which arms are hingedly mounted at their opposite ends to the casing 1. A pressing bar 46 is inserted between the two arms of this pair of arms 13, 14.

The rocker 4 comprises at its end which is supported on the spring 6 a pin 15, which is received in an oblong hole 16 of a supporting member 17. This supporting member 17 is pivotably mounted to a double lever 18, which is acted upon by the piston rod 19 of a piston 20. A pin 21 is, furthermore, mounted to mentioned piston 20, which pin 21 cooperates with an adjusting nut 22 which engages threadingly the casing 1.

Figure 5:
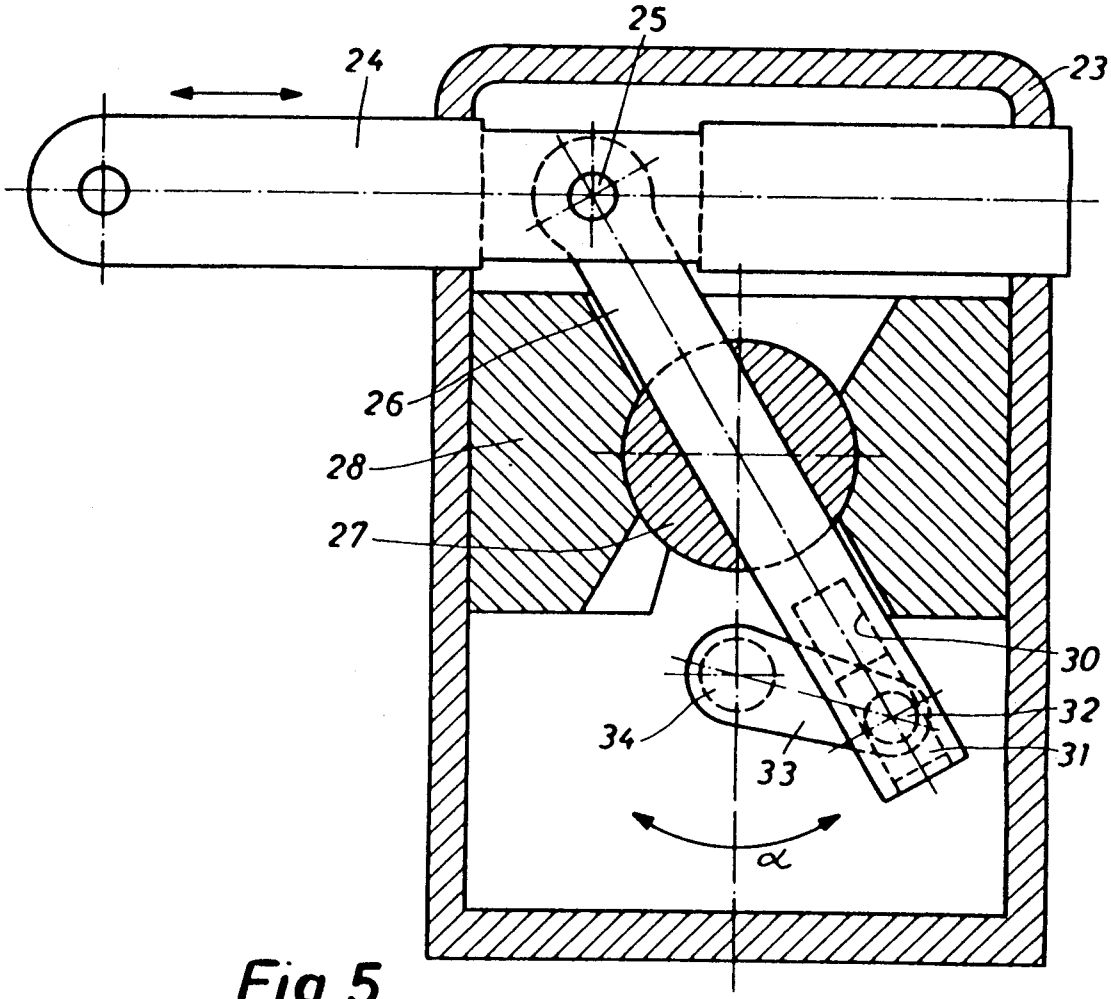
FIGS. 4 and 5 illustrate an apparatus for an oscillating driving of at least one shaft.
Figure 4:
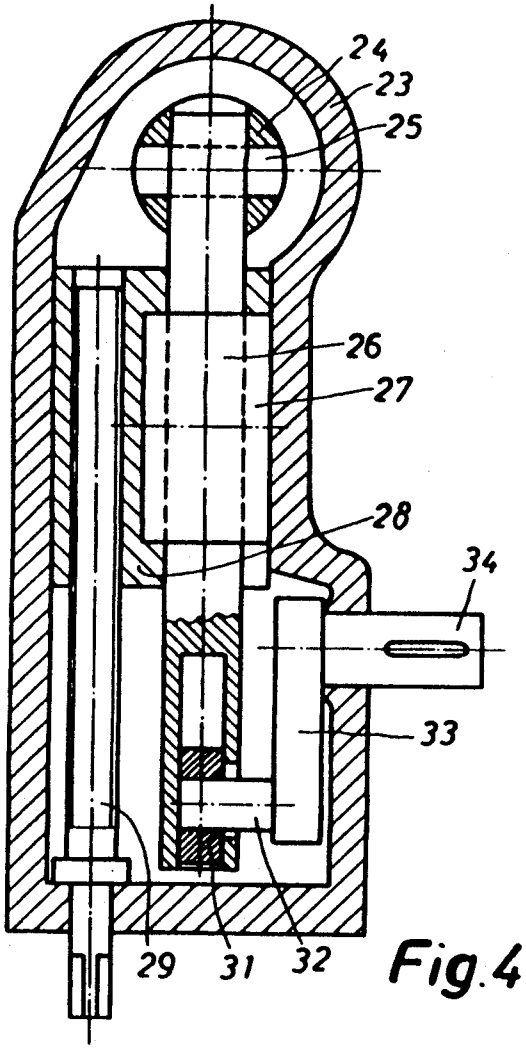

Based on FIGS. 4 and 5 the operation of the drive for an oscillating driving of at least one shaft will now be explained.

A rod 24 supported for longitudinal movement in a casing 23 is reciprocally moved, for instance, by means of a crank drive, which rod 24 drives a lever 26 which is pivotably mounted thereto via a pivot pin 25. This lever 26 is guided in a drum shaped guide member 27, which is supported in a bearing pedestal 28 having an inner thread. The bearing pedestal 28 is guided against a rotating within the casing 23 and a threaded spindle 29 extends therethrough. When the threaded spindle 29 is rotated, the bearing pedestal 28 shifts its location together with the guide member 27 such that the location of the center of rotation of this lever 26 can be adjusted or changed, respectively.

The lever 26 is designed as a hollow profile having gliding surfaces 30 located therewithin, in which gliding surfaces 30 a slide ring 31 is supported. The pivot 32 of a crank 33 extends through the slide ring 31. The crank 33 is connected to the oscillatingly driven shaft 34.

If now the rod 24 is reciprocated translatorically, the lever 26 is rotated reciprocatingly, whereby the axis of the drum shaped guide member 27 is the axis of rotation of this movement. The pivoting movement of the end of the lever 26 is transmitted via the slide ring 31 and the pivot 32 supported therein via the crank 33 onto the shaft 34 to be driven such that now this shaft 34 is oscillatingly driven.

If the threaded spindle 29 is rotated, the axis of rotation of the lever 26 can be adjusted, such that accordingly the magnitude of the deflection of the end of the lever 26 which supports the slide ring 31 can be adjusted and accordingly the amplitude of the oscillating movement of the shaft 34 can be adjusted.

It is, thereby, of decisive importance, that the translatory movement of the longitudinally movable supported rod 24 and the movement of the pivot pin 25 are always the same independently of mentioned deflection of the lever 26 and that the pivot pin 25 will always be in the same end positions, in which it reverses the direction of movement.

The drum shaped guide member 27 is inserted rotatably in the bearing pedestal 28 such that the geometric center of the drum shaped guide member 27 is located on the center axis of the lever 26. By means of this design and because the slide ring 31 is translatorically movable supported in the lever 26, the lever 26 is not subjected to torsional loadings, but rather only to bending loadings, such that a much smaller inner flexibility or yielding effect, respectively, of the apparatus is achieved. Furthermore, it is now also possible to design the casing 23 rather narrow such that a saving on space is arrived at.

Figure 8:
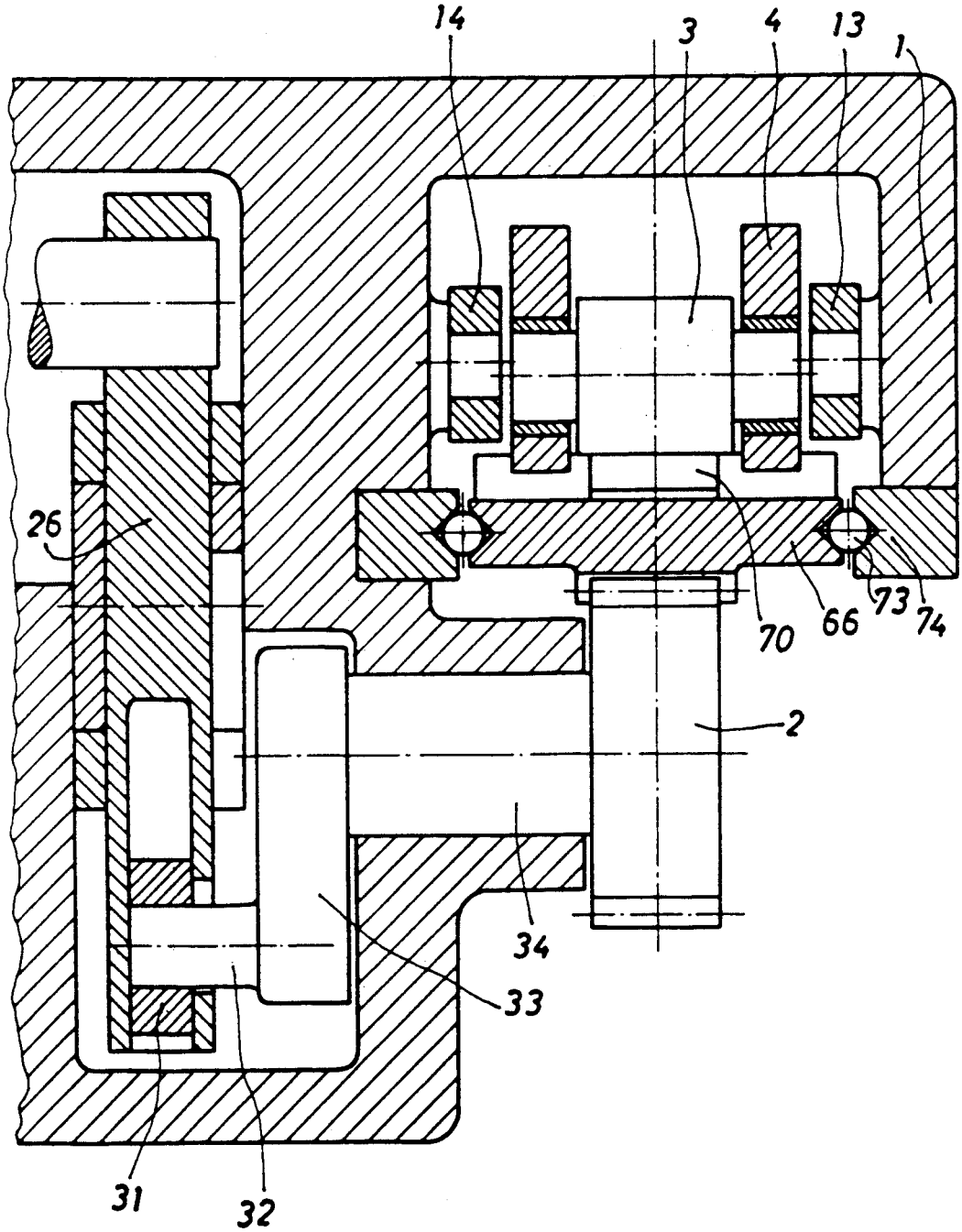

Based on the FIGS. 1-3 it now will be described how the principle of the driving as explained above is applied for the driving of the exemplary two feeding rollers 2 and 3. The drive shaft 11 supports at one of its ends a gear wheel 35, which meshes with a drive gear wheel 36 of a not particularly designed main drive. A gear wheel 37 is eccentrically supported in the drive shaft 11. This gear wheel 37 rolls along a gear ring 38 having an inner toothing which is inserted in the casing 1. The gear wheel 37 is rigidly connected to a coaxial disk 39. The disk has an eccentrically located pivot pin 25. (The pin is illustrated in FIGS. 1 and 8.) This pivot pin 25 is mounted to the lever 26, in which above mentioned slide ring 31 is located and in which the pivot 32 of the crank 33 is received, via which crank 33 the shaft 34 which is to be driven is driven oscillatingly. By means of the threaded spindle 29 the bearing pedestal 28, in which the drum shaped guide member 27 is supported, is screwed upwards or downwards, depending on the amplitude having been selected. The crank 33 includes a toothed segment 40, which meshes with a toothed segment of a disk or rocker arm 41, respectively. Via a suitable clutch 42 the oscillating movement of mentioned disk or rocker arm 41, respectively, is transmitted to the upper feeding roller 3.

By above structure the two feeding rollers 2 and 3 are oscillatingly driven in a contrarotating fashion.

The intermittent stepwise feeding of a workpiece, for instance, of a sheet metal web 43, which is located between the two feeding rollers 2 and 3, will now be described in detail. As already mentioned above, the drive shaft 11 includes a cam member 12 which in this embodiment is an integral part of the drive shaft 11. When the drive shaft 11 rotates, the roller 10 moves in an oscillating manner, which movement is transmitted via the lever 9, the shaft 8 located at the side thereof onto the rod 7 which is now oscillated accordingly. The rod 7 is pivotably mounted via the pin 47 to the rocker 4.

If now the rod 7 is moved downwards, it urges the rocker 4 against the force of the spring downwards. Due to the force exerted by the rod 7 onto the end of the rocker 4 supported on the spring 5 the rocker 4 is pivoted downwards around the pin 15 towards the sheet metal web 43. The upper feeding roller 2 is thereby pressed against the lower stationary supported feeding roller 3. The rod 7 continues to move downwards and due to this further movement the bite between the feeding rollers 2 and 3 becomes now the center of rotation of the rocker 4 such that conclusively the pressing bar 46 is lifted off. The rod 7 continues its downward movement such that the rocker 4 is now rotated or pivoted, respectively, around the mentioned center of rotation such that now the pin 15 is translated in the oblong hole 16. The two feeding rollers 2 and 3, which rotate during this period in the direction of workpiece feed, contact the sheet metal web 43 and advance the web (in the illustration of FIG. 2 towards the left hand side). Now the rod 7 begins to move upwards. The springs 5 and 6 cause thus a pivoting of the rocker 4 around the axis of the feeding roller 3, such that accordingly the pressing bar 46 is lowered again and clamps the sheet metal web 43 against an abutment 45 such that the web is arrested. After the clamping of the sheet metal web 43 the upper feeding roller 3 is lifted off. Accordingly the two feeding rollers 2 and 3 do no longer act onto the sheet metal web 43 and make during the rotating of the drive shaft 11 a movement opposite to the direction of feed.

Due to the illustrated structure it is no longer necessary to effect at the rocker any special measures for coping with various thicknesses of a respective sheet metal web 43 being fed.

The extent or distance, specifically of the feeding steps, is adjusted by an adjusting of the amplitude of the oscillating movement of the feeding rollers, i.e. such as mentioned above, by a translatory moving of the bearing pedestal 28 along the threaded spindle 29.

In order to initially insert the sheet metal web 43 to be fed the piston 20 is lowered and accordingly the rocker 4 raised via the supporting member 17. Accordingly, the pin 44 defines now the pivotal point of the rocker 4 such that the feeding roller 3 is lifted off. Because obviously the pressing bar 46 is lifted off, too, because the arms 13, 14 pivot around their pivotal point at the casing 1, the sheet metal web 43 can be freely inserted. The adjusting nut 22, which determines via the pin 21 the base position of the piston 20, is used for the adjusting of the height position of the supporting member 17, i.e. specifically of the oblong hole 16 thereof. It has been mentioned that during a pivoting of the rocker 4 the pin 15 moves in the oblong hole 16. If during the upwards moving of the rod 7 initially the roller 3 and thereafter the pressing bar 46 are lifted off the sheet metal web 43, the web lies completely free during a short time span, such that the arresting or locking, respectively, pins which, as is generally known, belong to the respective tool of a punching apparatus can center the sheet metal web 43 for the punching proper. Accordingly, the time span for the centering of the sheet metal web 43 by means of the locking pins may be adjusted by means of operating the adjusting nut 22.

With respect now specifically for an automatic adjusting of web thicknesses the following mutual conditions of the various pivotal points or pivot axes at these points are prevailing. The link member, i.e. the rod 7, is pivotably mounted to the rocker 4 and accordingly, a pivot axis 47 is present at the pivotal point. Furthermore, the pressing roller, i.e. here the upper feeding roller 3, has an axis of rotation 48. The arms 13, 14 are pivotably mounted to the rocker 4 at a pivot axis 52. On the other hand these arms 13, 14 are pivotably mounted to the casing 1 at a pivot axis 49 which pivot axis 49 in the illustrated position of the rocker 4 coincides with the axis of rotation 48 of the upper feeding roller 3. The pressing bar 46 comprises at its bottom converging area a pressing surface 51 which defines a longitudinal center plane 50. This longitudinal center plane 50 intersects the geometrical plane which is defined by or extends through, respectively, the axis of rotation 48 of the upper feeding roller 3 and the pivot axis 52 at the pivotal point of the pair of arms 13, 14 at the rocker 4 along a line of intersection 98 which is illustrated in FIG. 2. In order to fulfill the condition mentioned above, the following relationship prevails: the ratio of the distance (a) between the pivot axis 47 of the 7 and the pressing (e.g. axis of rotation 48 of the upper feeding) roller 3 to the distance (b) between the axis of rotation 48 and the pivot axis 52 of the arm pair 13, 14 on the rocker 4 equals the ratio of the distance (d) between the axis of rotation 48 and the line of intersection 98 the longitudinal center plane 50 of the pressing surface 51 of the pressing bar 46 and the plane extending through the axis of rotation 48 and the pivot axis 52 to the distance (c) between the pivot axis 52 and the line of intersection 98. In other words the following equation exists $$\frac{a}{b} = \frac{d}{c}.$$

The embodiment of the apparatus illustrated in FIG. 1 includes a driven upper feeding roller 3 and a driven lower feeding roller 2. In order, however, for feeding a web-shaped workpiece other embodiments can be applied, too.

Figure 6:
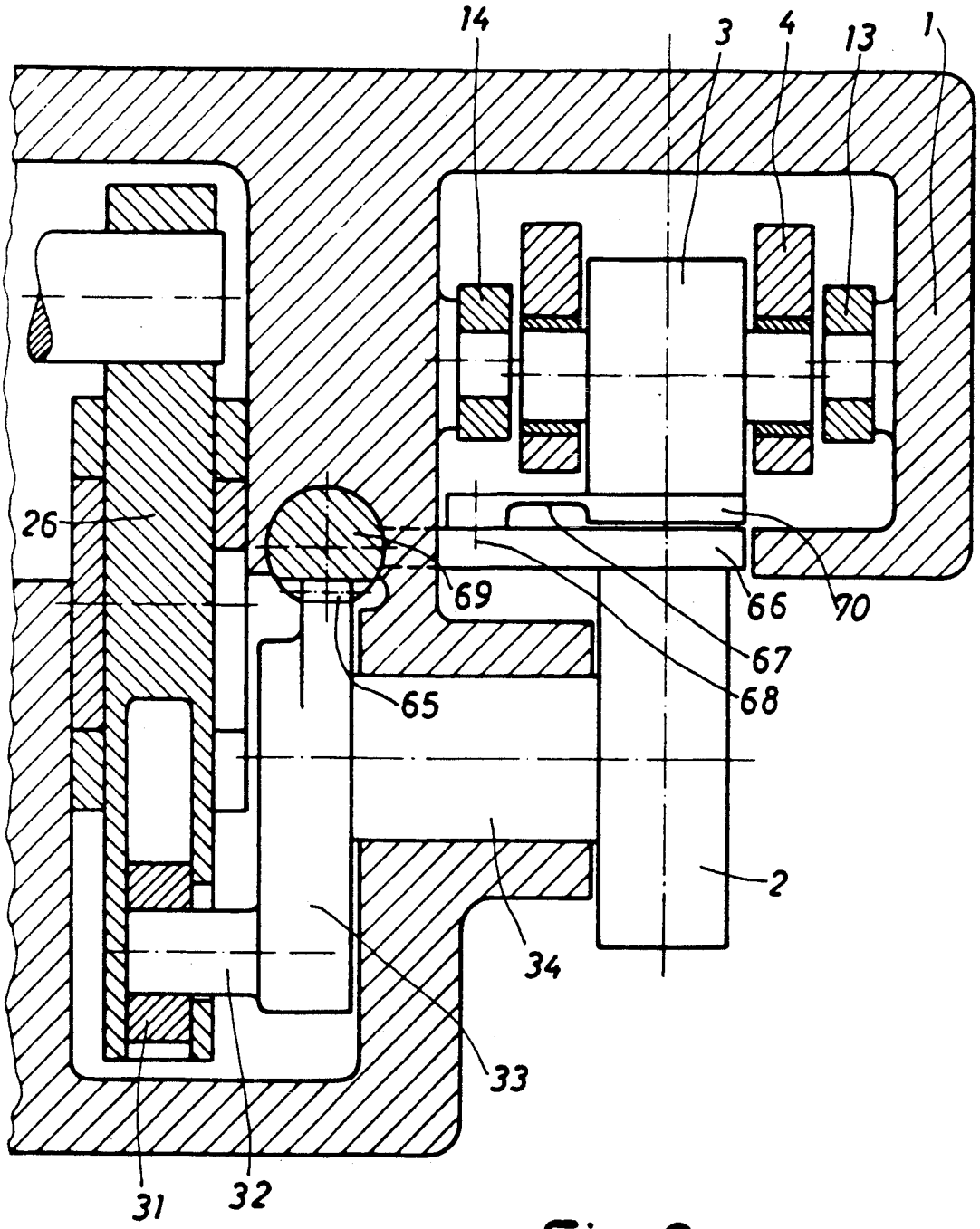
FIGS. 6–9 illustrate various embodiments of those structural members of the apparatus which are intended for pressing against and feeding a workpiece.

The crank 33 of the embodiment illustrated in FIG. 6 is coupled to the lower feeding roller 2 via the shaft 34 to be driven. The pressing roller 3 is not driven but rather supported freely rotatable in the rocker 4. The crank 33, which operates as oscillating member, comprises a toothed segment 65. A longitudinally movable sliding carriage or traveling carriage, respectively, 66 is supported in the casing 1 of the apparatus. A clamping member 70 is located above the carriage 66, which clamping member 70 includes at least one resilient section 67 and which is rigidly mounted e.g. by means of screw bolts to the sliding carriage 66 at the location identified by the reference numeral 68. At the side of the carriage 66 a rack 69 is connected thereto, which acts as circular guide and meshes with the toothed segment 65.

When operating this embodiment the sliding carriage 66 is moved oscillatingly back and forth. It rests thereby at its freely projecting end section on the lower feeding roller 2 which is also oscillatingly driven via the drive shaft 34, and which acts here basically only as supporting roller.

The upper feeding roller 3 is pressed by action of the rocking movement of the rocker 4 periodically against the clamping member 70 such that the intermittently fed sheet metal web is intermittently clamped and fed by the clamping member 70 and the carriage 66 which cooperate to form a clamp.

The embodiment according to FIG. 7 includes again a longitudinally movable or traveling, respectively, carriage 66. Again, a clamping member 70 is bolted onto the carriage 66. The pressing roller 3 is supported for free rotation in the rocker 4. The carriage 66 is equipped at its bottom with a rack 71. The lower feeding roller 2 is provided with a toothed ring 72 and is thus structured as a geared wheel, which causes the oscillating reciprocating movement of the carriage 66.

Figure 7:
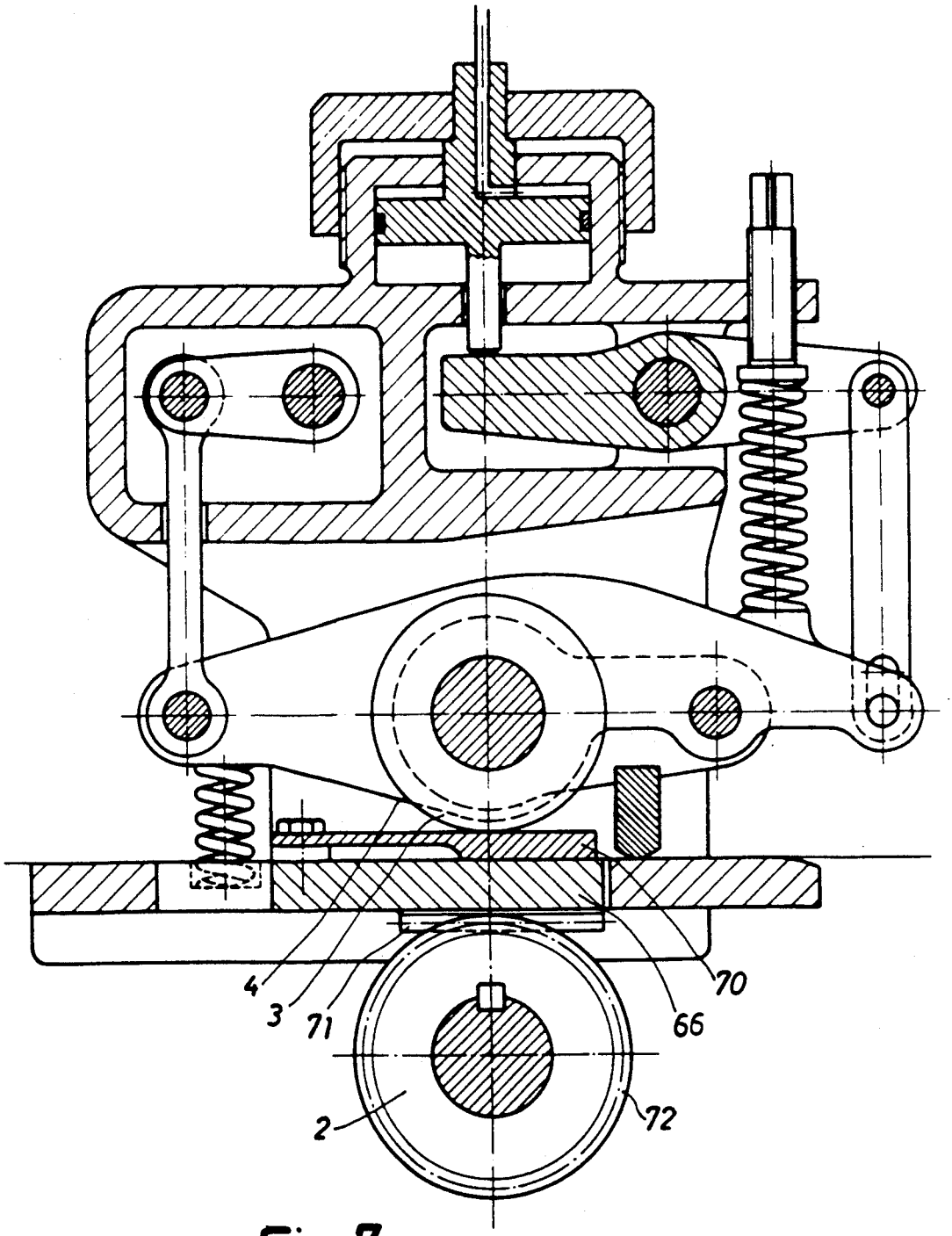
Figure 9:
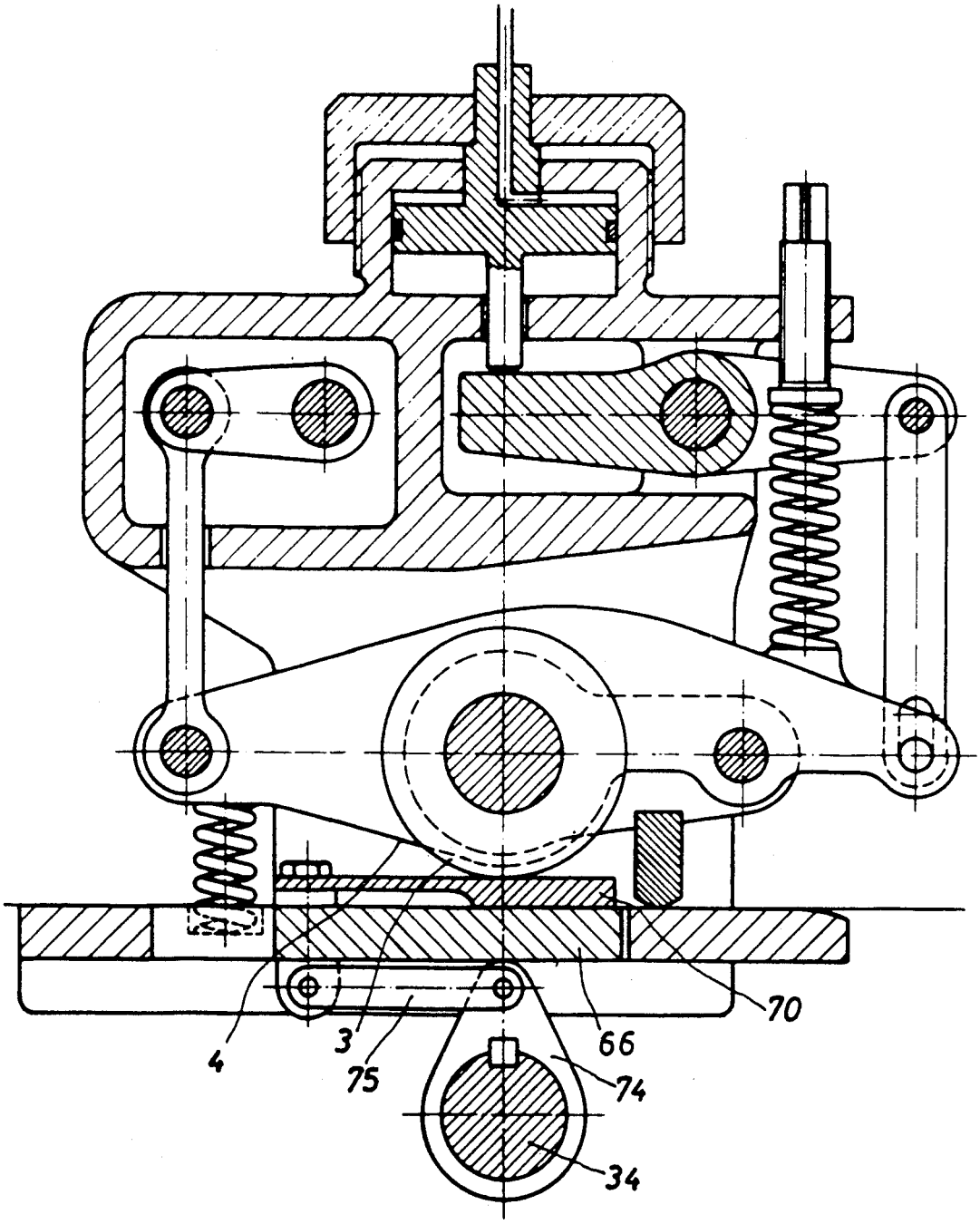

FIG. 8 illustrates basically the same embodiment as shown in FIG. 7, whereby, however, it shall be noted firstly, that the bottom of the clamping member 70 is not a planar area, but can be structured such that it can cooperate with already profiled webs. The carriage 66 is supported via rolling bodies, e.g. bearing balls, 73 in races 74 fixedly mounted to the casing 1, which races 74 have a prismatic cross-sectional shape. The driving shaft 34 of the embodiment illustrated in FIG. 9 is rigidly mounted to a plate 74 for rotation therewith, which plate 74 is hingedly mounted to the carriage 66. The other structural members correspond to those of the previously described embodiments.

While there are shown and described present preferred embodiments of the invention, it is to be distinctly understood that the invention is not limited thereto, but may be otherwise variously embodied and practiced within the scope of the following claims.

I claim:

1. An apparatus for intermittently feeding a web-shaped workpiece, the apparatus comprising:

a pressing roller (3);

a rocker (4) supporting said pressing roller (3) rotatably about a roller axis (48) at a location between first and second, opposite ends of said rocker (4);

an oscillatingly driven feeding member (2) cooperative with rocking of said rocker (4) and pressing roller (3) for intermittently pressing and feeding a web-shaped workpiece (43) in correspondence with the rocking when the web-shaped workpiece (43) is received between said pressing roller (3) and feeding member (2);

an oscillatingly driven link member (7) pivotably mounted to said first end of said rocker (4) for the rocking of same;

a first spring (5) at said first end of said rocker for rockably supporting same;

a supporting member (17) for further supporting said rocker at said second end thereof;

a further spring (6) at said second end of said rocker for still further supporting same; and arresting means for temporarily arresting the feeding of the web-shaped workpiece (43) between the intermittent feedings thereof, said arresting means comprising:

a pressing bar (46) for pressing the web-shaped workpiece (43) against a stationary abutment (45) of a frame (1), said pressing bar (46) being operatively connected to and extending between two pivot arms (13, 14), each pivot arm (13, 14) being pivotably mounted at an axis (52) at one of its ends to said rocker (4) and an another axis (49) at its opposite end to said frame (1) at a location such that, in one rocking position of said rocker, said other axis (49) coincides at least approximately with said roller axis (48) for rotational support of said pressing roller on said rocker, wherein said supporting member (17) comprises a hole (16) that is oblong laterally relative to a longitudinal extent of the rocker between said first and second ends thereof, a pin (15) of the rocker being received in said oblong hole, said supporting member (16) being coupled to an adjusting-unit means (20, 21) for adjusting the position of said oblong hole in the direction of the rocking movement relative to said pin of said rocker, whereby the inclination of said rocker when it is in a position contacting and thus supported by said rocker is adjustable, in which inclined position of said rocker said pressing roller and said arresting means may jointly be lifted off a respective workpiece by said link member.

2. The apparatus of claim 1, wherein said pressing roller is a first feeding roller and said feeding member is a further stationarily supported feeding roller arranged to contrarotate relative to said first feeding roller.

3. An apparatus for intermittent feeding of a web-shaped workpiece, including a pressing roller operative to periodically exert a pressure onto a workpiece and rotatably supported in a rocker at a location between the ends thereof; and including an oscillatingly driven feeding member cooperating with said pressing roller, which pressing roller and which feeding member are arranged to receive the web-shaped workpiece therebetween; and including a means for a temperarily arresting of the web-shaped workpiece between two subsequent feeding steps by a pressing thereof against a stationary structure; comprising an oscillatingly movable link member and a first spring, which link member is pivotably mounted to one end of said rocker for driving same, at which end the rocker is supported further on said first spring; comprising further a supporting member and a further spring, on which supporting member said rocker is supportable at its other end, which end is further supported on said further spring; and which arresting means comprises a pressing bar located between two pivot arms pivotably mounted at one of their ends to said rocker and at their opposite end to a frame part of the apparatus at a location at which in one rocking position of said rocker their pivot axis coincides at least approximately with the axis of rotation of said pressing roller supported in said rocker, and wherein said oscillatingly driven feeding member cooperating with said pressing roller comprises a feeding clamp unit having a longitudinally travelling carriage, on which a resilient pressing member is arranged which is intended to be pressed by action of said pressing roller against said carriage, which carriage is mounted to a at a side thereof to a rack which meshes with a toothed segment of an oscillatingly driven oscillating member, which oscillating member is rigidly mounted via a shaft to a supporting roller supporting said carriage against said pressing roller.

4. The apparatus of claim 3, wherein said supporting member includes an oblong hole which extends laterally relative to the longitudinal extent of the rocker and in which a pin of the rocker is received, which supporting member is coupled to an adjusting unit, by means of which the position of the oblong hole is adjustable in the direction of the rocking movement relative to said pin of the rocker, whereby the inclination of the rocker when it is in a position contacting and thus supported by the rocker is adjustable, in which supported inclined position of said rocker said pressing roller and said arresting means may jointly be lifted off a respective workpiece by said link member.

5. The apparatus of claim 3, wherein said pressing bar has an elongated pressing surface extending perpendicularly to the direction of the intermittent feeding of the web-shaped workpiece, wherein the ratio of the distance between a pivot axis of said pivotable mounting of said link member and an axis of the rotation of said pressing roller to the distance between the axis of the rotation of said pressing roller and a pivot axis of said pivotable mounting of said pivot arms on said rocker equals the ratio of the distance between the axis of rotation of said pressing roller and a line of intersection of a longitudinal center plane of said pressing surface of said pressing bar and a plane extending through the axis of rotation of said pressing roller and the pivot axis of said pivot arms to the distance between the pivot axis of said pivot arms and the line of intersection.

6. An apparatus for intermittent feeding of a web-shaped workpiece, including a pressing roller operative to periodically exert a pressure onto a workpiece and rotatably supported in a rocker at a location between the ends thereof; and including an oscillatingly driven feeding member cooperating with said pressing roller, which pressing roller and which feeding member are arranged to receive the web-shaped workpiece therebetween; and including a means for a temperarily arresting of the web-shaped workpiece between two subsequent feeding steps by a pressing thereof against a stationary structure; comprising an oscillatingly movable link member and a first spring, which link member is pivotably mounted to one end of said rocker for driving same, at which end the rocker is supported further on said first spring; comprising further a supporting member and a further spring, on which supporting member said rocker is supportable at its other end, which end is further supported on said further spring; and which arresting means comprises a pressing bar located between two pivot arms pivotably mounted at one of their ends to said rocker and at their opposite end to a frame part of the apparatus at a location at which in one rocking position of said rocker their pivot axis coincides at least approximately with the axis of rotation of said pressing roller supported in said rocker, and wherein said oscillatingly driven feeding member cooperating with said pressing roller comprises a feeding clamp unit having a longitudinally travelling carriage, on which a resilient pressing member is arranged, which is intended to be pressed by action of said pressing roller against said carriage, which carriage includes at its bottom side a rack which meshes with a toothed driving roller driven to contrarotate relative to said pressing roller.

7. The apparatus of claim 6, wherein said supporting member includes an oblong hole which extends laterally relative to the longitudinal extent of the rocker and in which a pin of the rocker is received, which supporting member is coupled to an adjusting unit, by means of which the position of the oblong hole is adjustable in the direction of the rocking movement relative to said pin of the rocker, whereby the inclination of the rocker when it is in a position contacting and thus supported by the rocker is adjustable, in which supported inclined position of said rocker said pressing roller and said arresting means may jointly be lifted off a respective workpiece by said link member.

8. The apparatus of claim 6, wherein said pressing bar has an elongated pressing surface extending perpendicularly to the direction of the intermittent feeding of the web-shaped workpiece, wherein the ratio of the distance between a pivot axis of said pivotable mounting of said link member and an axis of the rotation of said pressing roller to the distance between the axis of the rotation of said pressing roller and a pivot axis of said pivotable mounting of said pivot arms on said rocker equals the ratio of the distance between the axis of rotation of said pressing roller and a line of intersection of a longitudinal center plane of said pressing surface of said pressing bar and a plane extending through the axis of rotation of said pressing roller and the pivot axis of said pivot arms to the distance between the pivot axis of said pivot arms and the line of intersection.

9. An apparatus for intermittent feeding of a web-shaped workpiece, including a pressing roller operative to periodically exert a pressure onto a workpiece and rotatably supported in a rocker at a location between the ends thereof; and including an oscillatingly driven feeding member cooperating with said pressing roller, which pressing roller and which feeding member are arranged to receive the web-shaped workpiece therebetween; and including a means for a temperarily arresting of the web-shaped workpiece between two subsequent feeding steps by a pressing thereof against a stationary structure; comprising an oscillatingly movable link member and a first spring, which link member is pivotably mounted to one end of said rocker for driving same, at which end the rocker is supported further on said first spring; comprising further a supporting member and a further spring, on which supporting member said rocker is supportable at its other end, which end is further supported on said further spring; and which arresting means comprises a pressing bar located between two pivot arms pivotably mounted at one of their ends to said rocker and at their opposite end to a frame part of the apparatus at a location at which in one rocking position of said rocker their pivot axis coincides at least approximately with the axis of rotation of said pressing roller supported in said rocker, and wherein said said pressing roller comprises a feeding clamp unit having a longitudinally travelling carriage on which a resilient pressing member is arranged which is intended to be pressed by action of said pressing roller against said carriage, which carriage is drivingly coupled via a link member to an oscillatingly driven crank.

10. The apparatus of claim 9, wherein said supporting member includes an oblong hole which extends laterally relative to the longitudinal extent of the rocker and in which a pin of the rocker is received, which supporting member is coupled to an adjusting unit, by means of which the position of the oblong hole is adjustable in the direction of the rocking movement relative to said pin of the rocker, whereby the inclination of the rocker when it is in a position contacting and thus supported by the rocker is adjustable, in which supported inclined position of said rocker said pressing roller and said arresting means may jointly be lifted off a respective workpiece by said link member.

11. The apparatus of claim 9, wherein said pressing bar has an elongated pressing surface extending perpendicularly to the direction of the intermittent feeding of the web-shaped workpiece, wherein the ratio of the distance between a pivot axis of said pivotable mounting of said link member and an axis of the rotation of said pressing roller to the distance between the axis of the rotation of said pressing roller and a pivot axis of said pivotable mounting of said pivot arms on said rocker equals the ratio of the distance between the axis of rotation of said pressing roller and a line of intersection of a longitudinal center plane of said pressing surface of said pressing bar and a plane extending through the axis of rotation of said pressing roller and the pivot axis of said pivot arms to the distance between the pivot axis of said pivot arms and the line of intersection.

12. An apparatus for intermittent feeding of a web-shaped workpiece, including a pressing roller operative to periodically exert a pressure onto a workpiece and rotatably supported in a rocker at a location between the ends thereof; and including an oscillatingly driven feeding member cooperating with said pressing roller, which pressing roller and which feeding member are arranged to receive the web-shaped workpiece therebetween; and including a means for a temperarily arresting of the web-shaped workpiece between two subsequent feeding steps by a pressing thereof against a stationary structure; comprising an oscillatingly movable link member and a first spring, which link member is pivotably mounted to one end of said rocker for driving same, at which end the rocker is supported further on said first spring; comprising further a supporting member and a further spring, on which supporting member said rocker is supportable at its other end, which end is further supported on said further spring; and which arresting means comprises a pressing bar located between two pivot arms pivotably mounted at one of their ends to said rocker and at their opposite end to a frame part of the apparatus at a location at which in one rocking position of said rocker their pivot axis coincides at least approximately with the axis of rotation of said pressing roller supported in said rocker, and wherein said oscillatingly driven feeding member cooperating with said pressing roller includes a longitudinally travelling carriage supported on rolling bodies located in races having a prismatic cross-sectional shape, and wherein a pressing plate is arranged on said carriage and intended to be pressed by action of said pressing roller against a respective workpiece, which carriage includes at its bottom a rack which meshes with a toothed driving roller driven to contrarotate relative to said pressing roller.

13. The apparatus of claim 12, wherein said supporting member includes an oblong hole which extends laterally relative to the longitudinal extent of the rocker and in which a pin of the rocker is received, which supporting member is coupled to an adjusting unit, by means of which the position of the oblong hole is adjustable in the direction of the rocking movement relative to said pin of the rocker, whereby the inclination of the rocker when it is in a position contacting and thus supported by the rocker is adjustable, in which supported inclined position of said rocker said pressing roller and said arresting means may jointly be lifted off a respective workpiece by said link member.

14. The apparatus of claim 12, wherein said pressing bar has an elongated pressing surface extending perpendicularly to the direction of the intermittent feeding of the web-shaped workpiece, wherein the ratio of the distance between a pivot axis of said pivotable mounting of said link member and an axis of the rotation of said pressing roller to the distance between the axis of the rotation of said pressing roller and a pivot axis of said pivotable mounting of said pivot arms on said rocker equals the ratio of the distance between the axis of rotation of said pressing roller and a line of intersection of a longitudinal center plane of said pressing surface of said pressing bar and a plane extending through the axis of rotation of said pressing roller and the pivot axis of said pivot arms to the distance between the pivot axis of said pivot arms and the line of intersection.

* * * * *